United States Patent [19]

Terada et al.

[11] Patent Number: 5,067,209

[45] Date of Patent: Nov. 26, 1991

[54] SLIDE FASTENER SLIDER

[75] Inventors: Yasuharu Terada, Uozu; Susumu Ishii, Kurobe; Hiroshi Mizuno, Toyama, all of Japan

[73] Assignee: Yoshida Kogyo K.K., Tokyo, Japan

[21] Appl. No.: 594,697

[22] Filed: Oct. 9, 1990

[30] Foreign Application Priority Data

Oct. 17, 1989 [JP] Japan ..... 1-121345[U]

[51] Int. Cl.[5] ..... A44B 19/26

[52] U.S. Cl. ..... 24/429; 24/419

[58] Field of Search ..... 24/429, 419, 437, 381, 24/428, 430

[56] References Cited

U.S. PATENT DOCUMENTS

| | | | |
|---|---|---|---|
| 1,715,976 | 6/1929 | Baker . | |
| 1,962,479 | 6/1934 | Carlile . | |
| 2,178,948 | 11/1939 | Brozek . | |
| 2,240,704 | 5/1941 | Lange | 24/419 |
| 2,307,711 | 1/1943 | Schaaff . | |
| 2,316,133 | 4/1943 | Schaaff . | |
| 2,495,176 | 1/1950 | Nissen | 24/429 |
| 2,671,258 | 3/1954 | Lackritz | 24/419 |
| 2,681,492 | 6/1954 | Lackritz | 24/429 |
| 2,752,655 | 7/1956 | Carlile . | |
| 2,785,452 | 3/1957 | Garsson . | |
| 2,792,611 | 5/1957 | Morin . | |
| 2,864,146 | 12/1958 | Morin . | |
| 3,075,269 | 1/1963 | Simberg | 24/419 |
| 3,343,235 | 9/1967 | Morin | 24/429 |
| 3,376,617 | 4/1968 | Snyder | 24/419 |
| 3,718,949 | 3/1973 | Harlam et al. | 24/429 |

FOREIGN PATENT DOCUMENTS 1282614 12/1960 France .

*Primary Examiner*—Victor N. Sakran

*Attorney, Agent, or Firm*—Hill, Van Santen, Steadman & Simpson

[57] ABSTRACT

A slide fastener slider includes a slider body having a mounting hole extending at least through the thickness of an upper wing of the slider body, a circular disk disposed on the upper wing with its central guide hole aligned with the mounting hole, a pull tab pivotally connected to the circular disk, and a headed retainer pin extending loosely through the guide hole and firmly fitted in the mounting hole to rotatably retain the circular disk on the slider body. The circular disk is substantially concealed by an enlarged head of the retainer pin and hence the slider is sightly in appearance. The mounting hole in which the retainer pin is firmly fitted extends through a guide post of the slider body so that the pull tab is firmly retained on the slider body against detachment even when the pull tab is manipulated with a severe pulling force.

7 Claims, 4 Drawing Sheets

SLIDE FASTENER SLIDER

BACKGROUND OF THE INVENTION

1. Field of the Invention

The present invention relates generally to sliders for slide fasteners, and more particularly to a slide fastener slider having a pull tab pivotably and rotatably connected to the upper surface of a slider body.

2. Description of the Prior Art

Japanese Utility Model Publication Nos. 37-8615 and 46-10186, for example, disclose conventional slide fastener sliders of the type concerned which include a pull tab pivotably and rotatably connected to the upper surface of a slider body.

The slide fastener slider disclosed in Japanese Utility Model Publication No. 37-8615 includes a pull tab retainer having a support shaft rotatably received in a hole extending through the upper wing of a slider body. A lower end portion of the support shaft projecting from the under surface the upper wing is deformed by clinching into an axially compressed, radially extended flat hoot, so that the pull tab retainer is rotatably mounted on the slider body. A pull tab is pivotably connected to an upper end of the rotatable pull tab retainer.

With this construction, since the pull tab retainer is mounted only on the upper wing, and since the upper wing is relatively thin, the pull-tab mounting strength of the slide fastener slider is relatively low. Furthermore, the clinching operation achieved at the underside of the upper wing makes it uneasy to assemble the pull tab retainer with the slider body.

The slide fastener slider disclosed in Japanese Utility Model Publication No. 46-10186 includes a pull tab retainer having a flanged shaft rotatably received in a recess formed in the upper surface of a relatively thick upper wing of a slider body, and a ring cover firmly fitted with the recess to rotatably retain a flange on the shaft within the recess. Thus, the pull tab retainer is rotatably mounted on the upper wing. A pull tab is pivotably connected to an upper end of the pull tab retainer.

The upper wing to which the pull tab retainer is mounted is relatively thick and hence the pull-tab mounting strength provided by such relatively thick upper wing increases correspondingly. However, because a region available for the mounting of the pull tab retainer is still within the limit of the thickness of the upper wing, the pull-tab mounting strength necessarily has a corresponding upper limit. Furthermore, the slider body having such thick upper wing gives a feeling of unsightliness to the user.

SUMMARY OF THE INVENTION

With the foregoing difficulties in view, it is an object of the present invention to provide a slide fastener slider which is capable of retaining a pivotably and rotatably mounted pull tab at an increased mounting strength on a slider body and also is sightly in appearance.

A slide faster slider according to the present invention includes a slider body including a pair of spaced upper and lower wings connected at their front end by a guide post, the slider body having a mounting hole extending at least through the thickness of the upper wing. A circular disk having a central guide hole is disposed on the upper wing with the guide hole aligned with the mounting hole, and a pull tab is pivotally connected to the circular disk. A retainer pin has an enlarged head having a diameter substantially the same as the outside diameter of the circular disk, and a shank integral with the head and extending loosely through the guide hole and firmly fitted in the mounting hole to join the retainer pin with the slider body while allowing the circular disk to rotate freely about the shank. Thus, the pull tab is permitted to swing in any direction within a space above the upper wing.

The mounting hole may extend through the guide post of the body so as to firmly retain the circular disk and the pull tab on the slider body even when the pull tab is manipulated with a severe pulling force. The rotatable circular disk is concealed by the enlarged head of the retainer pin and hence the slider is sightly in appearance.

The above and other objects, features and advantages of the present invention will become manifest to those versed in the art upon making reference to the detailed description and the accompanying sheets of drawings in which preferred structural embodiments incorporating the principles of the present invention are shown by way of illustrative example.

DETAILED DESCRIPTION

Figure 1:
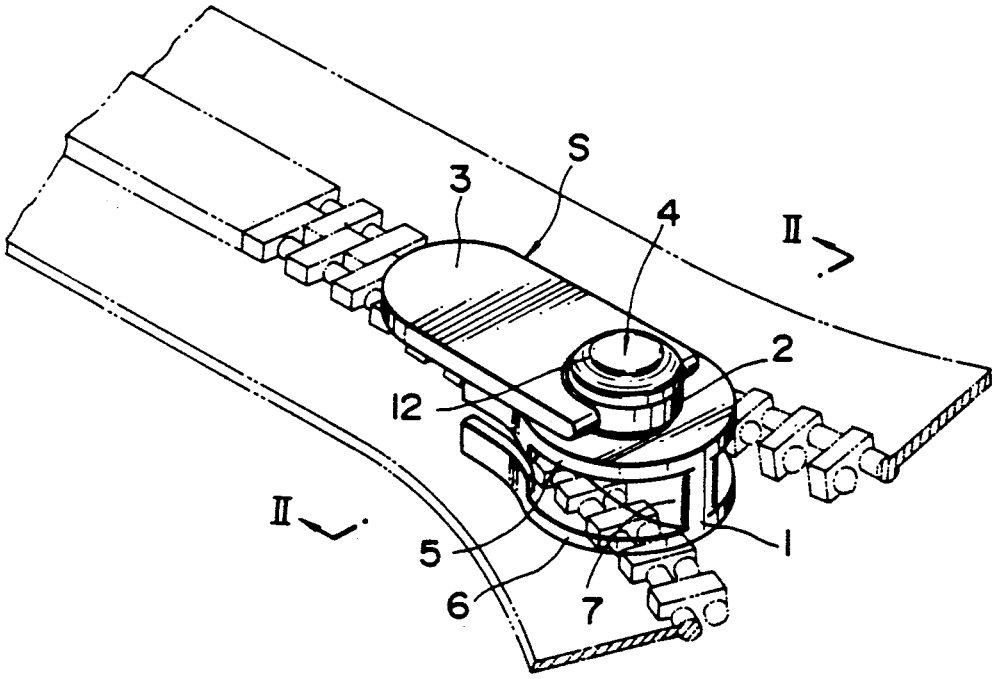
FIG. 1 is a perspective view of a slide fastener slider according to the present invention.
Figure 2:
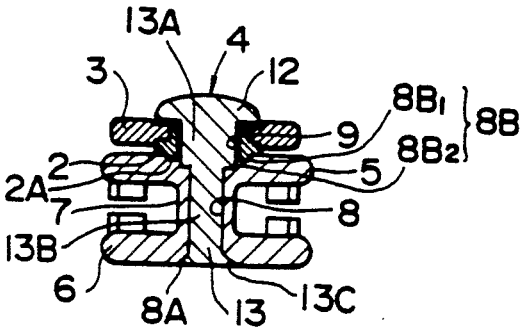
FIG. 2 is a cross-sectional view taken along line II —II of FIG. 1.

The present invention will be described hereinbelow in detail with reference to certain preferred embodiments shown in the accompanying drawings.

FIGS. 1 through 4 shows a slider S (FIG. 1) for a slide fastener according to a first embodiment of the present invention, The slider S comprises a slider body 1, a circular disk 2 with a pull tab 3 pivoted thereon, and a retainer member 4 that are assembled together in stacked relation.

The slider body 1 includes a pair of parallel spaced upper and lower wings 5 and 6 joined at their front end by a guide post or neck 7. The slider body 1 further has a vertical mounting hole 8 extending from the upper wing 5 to the lower wing 6 through the guide post 7. The mounting hole 8 has a downwardly flared lower end 8A opening to the outer surface of the lower wing 6 for a purpose described below. The mounting hole 8 also includes a stepped counterbore 8B opening to the outer surface of the upper wing 5 and composed of a large-diameter upper portion $8B_1$ and a small-diameter lower portion $8B_2$.

The circular disk 2 is mounted on the upper wing 5 of the slider body 1 and has a central guide hole 9 which is larger in diameter than the mounting hole 8. The circular disk 5 further has a pair of diametrically opposite cutaway recesses 10, 10 formed in its outer peripheral wall for a purpose described later, and a small-diameter lower portion 2A slidably received in the large-diameter upper portion $8B_1$ of the stepped counterbore 8B.

The pull tab 3 is in the shape of a substantially rectangular plate and has a bifurcated fore end portion having a pair of aligned spindles 11, 11 loosely received in the cutaway recesses 10, 10, respectively, for functioning as a pivot with the circular disk 2.

The retaining member 4 is in the shape of a headed pin and includes an enlarged circular head 12 having a diameter substantially the same as the outside diameter of the circular disk 2, and a cylindrical shank 13 extending centrally from the underside of the circular head 12. The shank 13 is stepped and includes a large-diameter upper portion 13A loosely received in the guide hole 9 of the circular disk 2 and a smaller-diameter lower portion 13B firmly received in the mounting hole 8 to join the retainer pin 4 with the slider body 1. The large-diameter upper portion 13A is also fitted in the small-diameter lower portion $8B_2$ of the stepped counterbore 8B. The large-diameter upper portion 13A has a length slightly larger than the sum of the thickness of the circular disk 2 and the depth of the smaller-diameter lower portion $8B_2$ of the stepped counterbore 8B. The lower end of the shank 13 is flared as at 13C so as to conform to the shape of the flared lower end 8A of the mounting hole 8.

Figure 3:
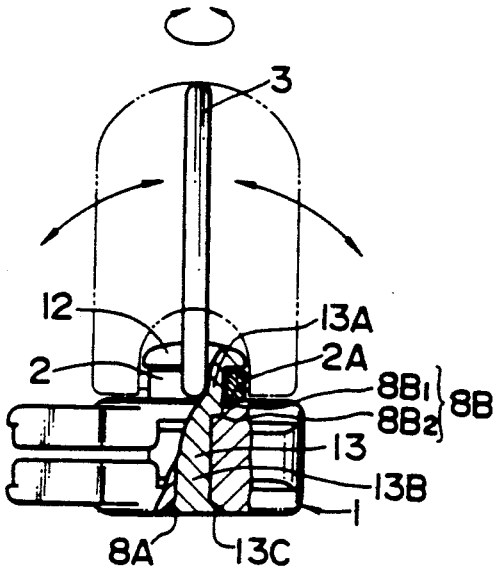
FIG. 3 is a side view, with part cutaway for clarity, of the slide fastener slider.

With the slide fastener slider thus constructed, the pull tab 3 pivoted on the circular disk 2 is pivotably and rotatably mounted on the slider body 1, as shown in FIG. 3.

Figure 4:
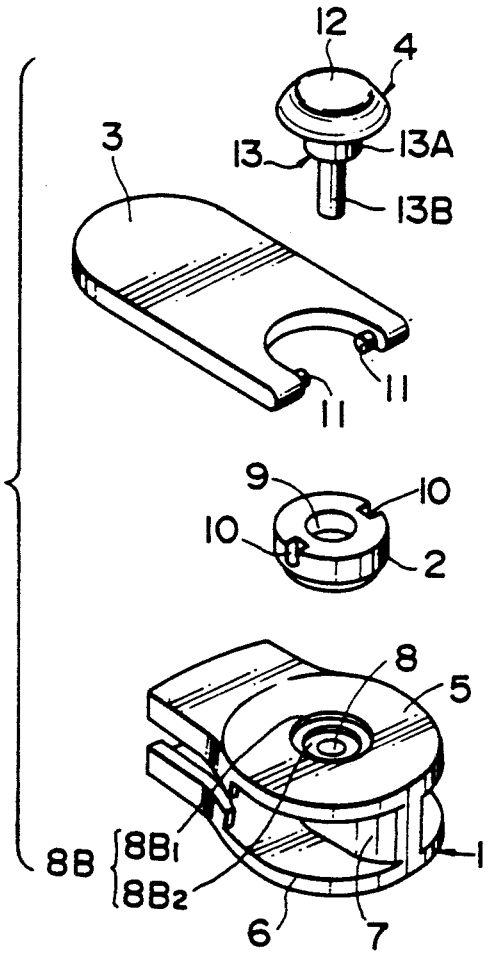
FIG. 4 is an exploded perspective view of the slide fastener slider shown with slider components ready to assembling.

For assembling, as shown in FIG. 4, the slider body 1 is held in a horizontal plane and while keeping this condition, the circular disk 2 is placed on the upper wing 5 of the slider body 1 with its small-diameter lower portion 2A slidably received in the large-diameter upper portion $8B_1$ of the stepped counterbore 8B. Subsequently, the spindles 11 of the pull tab 3 are received in the cutaway recesses 10 in the circular disk 2 to pivot the pull tab 3 with the circular disk 2. Thereafter, a undeformed straight shank 13 of a retainer pin 4 is inserted through the guide hole 9 in the circular disk 2 into the mounting hole 8 in the slider body 1 until the large-diameter upper portion 13A of the shank 13 is seated on the small-diameter lower portion $8B_2$ of the counterbore 8B. In this instance, the circular disk 2 and the head 12 of the retainer pin 4 is axially spaced a distance from one another, and the lower end of the shank 13 is not flared and slightly projects from the outer surface of the lower wing 6. Then, the thus-projecting lower end of the shank 13 is clinched by punching against the lower wing 6 and deforms into a downwardly flared end 13C (FIGS. 2 and 3) which is complementary in contour to the shape of the flared end 8A of the mounting hole 8. The retainer pin 4 is thus joined with the slider body 1 to rotatably retain the circular disk 2 on the slider body 1. The pull tab 3 pivotally connected to the rotatable circular disk 2 is, therefore, permitted to swing in any direction within a space above the upper wing 5.

With the slider thus constructed, since the retainer pin 4 rotatably holding the circular disk 2 with the pull tab 3 pivoted thereon is firmly received in the mounting hole 8 extending through the guide post 7 of the slider body 1, the pull tab 3 is firmly retained on the slider body 1 against detachment even when it is manipulated with a severe pulling force to open and close a slide fastener on which the slider is mounted. The retainer pin 4 mounted by using the guide post 7 obviates the need to increase the thickness of the upper wing 5 and the overall thickness of the slider body 1, so that the slider does not give a feeling of unsightliness to the user. Inasmuch as the head 12 of the retainer pin 4 has substantially the same diameter as the circular disk 2, the circular disk 2 is concealed as viewed from the above. Furthermore, the flared end 13C of the shank 13 which is formed by clinching is fully received in the complementary flared end 8A of the mounting hole 8. This arrangement makes the slider appear sightly. The slider can be assembled with utmost ease because the slider body 1, the circular disk 2 with the pull tab 3 pivoted thereon, and the retainer pin 4 can be preassembled by merely stacking them one above another in the order named.

In the foregoing embodiment, the slider body 1 and the retainer pin 4 are made of metal and they are joined together by clinching. The slider body 1 and the retainer pin 4 may be molded of synthetic resin in which instance they are joined together by ultrasonic welding or high-frequency welding.

Figure 5:
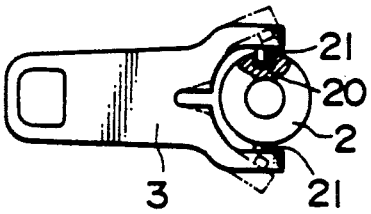
FIG. 5 is a plan view, partly in cross section, of a modified joint structure between a pull tab and a rotatable circular disk.

FIG. 5 illustrates a modified joint structure between the pull tab 3 and the circular disk 2. The circular disk 2 has a pair of diametrically opposite radial blind holes 20 (only one shown) formed in its outer peripheral wall. Before being attached to the circular disk 2, the bifurcated end of the pull tab 3 is spread as indicated by the phantom lines. The bifurcated end is contracted so that spindles 21 on the bifurcated end are fitted in the radial blind holes 20 to thereby pivot the pull tab 3 with the circular disk 2.

Figure 6:
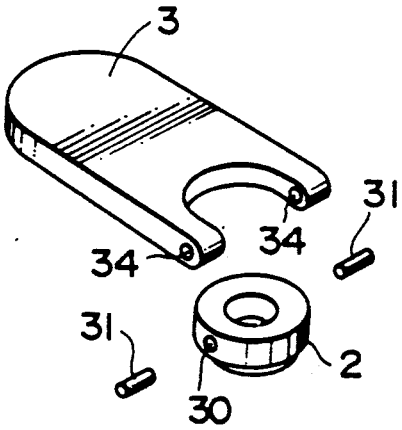
FIG. 6 is an exploded perspective view of a pull tab and a rotatable circular disk according to another embodiment of the invention.

As shown in FIG. 6, the pull tab 3 may have a pair of aligned transverse holes 34, 34 extending across its bifurcated end. While the transverse holes 34 are held in alignment with a pair of diametrically opposite radial blind holes 30 (only one shown) in the circular disk 2, a pair of pivot pins 31, 31 are inserted into longitudinally aligned transverse and radial hole pairs 34, 30, respectively, to join the pull tab 3 and the circular disk 2. Subsequently, open ends of the transverse holes 34 are caulked by hammering, thereby preventing the pivot pins 31 from displacing off the joint between the pull tab 3 and the circular disk 2. In case where the pull tab 2 and the pivot pins 31 are molded of synthetic resin, they may be joined together by ultrasonic welding or high-frequency welding.

Figure 7:
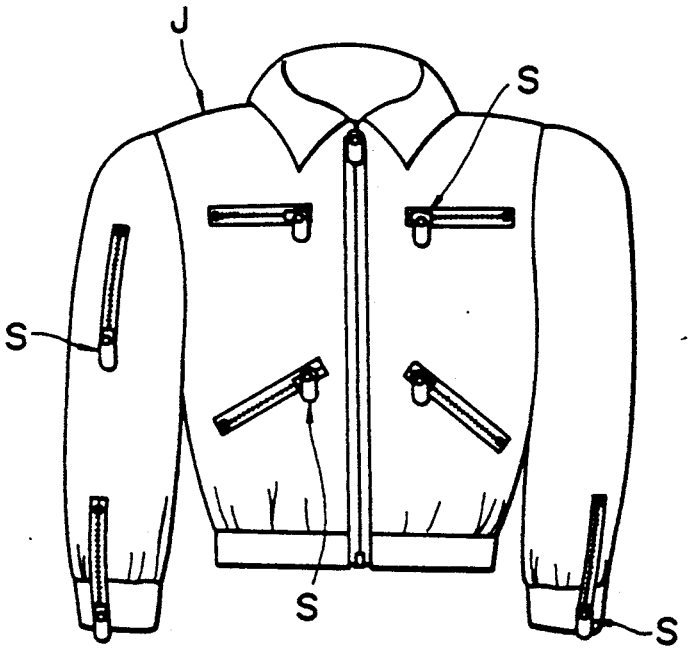
FIGS. 7 and 8 are diagrammatical views illustrative of different modes of application of the slide fastener slider of the present invention.

FIG. 7 diagrammatically illustrates a jacket J on which a plurality of slide fasteners having sliders S of the present invention are used as closures for pockets and cuffs of the jacket J. Openings to be opened and closed by the respective slide fasteners extend in different directions (i.e., they extend horizontally in one place, obliquely in another place and vertically in still another place), however, all the pull tabs of the sliders S extend vertically downwardly and lie flat over the outer surface of the jacket J. This is because when the user releases the slider pull tab, the pull tab pivoted on the circular disk 2 automatically reclines into its recumbent position on the upper wing of the slider S while turning into the vertically depending position due to its own weight. The slide fastener sliders having such pull tabs are sightly in appearance, free from damage which would otherwise be caused when the pull tabs project outwardly from the plane of the jacket J, and improve the product value of the jacket J.

Figure 8:
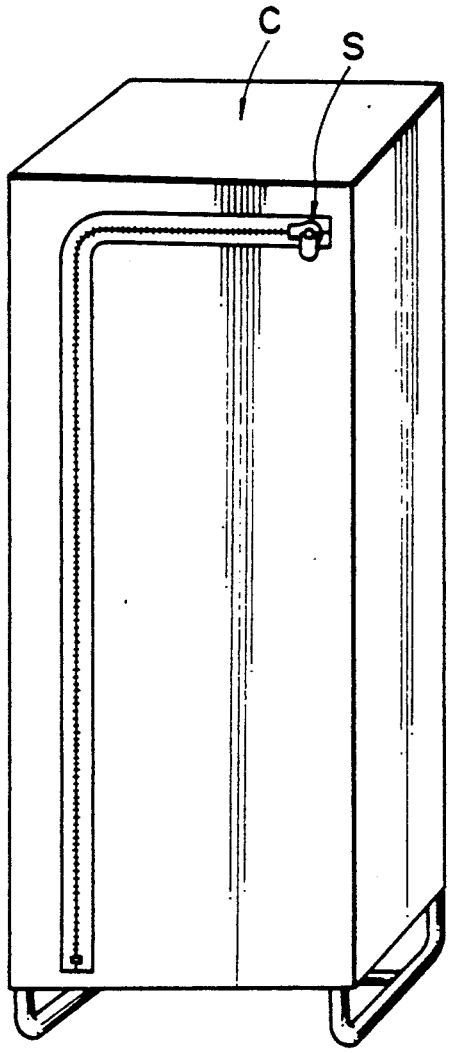

FIG. 8 shows a garment case C having a substantially inverted L-shaped opening adapted to be opened and closed by a slide fastener on which the slider S of the present invention is mounted. Since the pull tab is pivotally and rotatably movable relative to the slider body, the user is able to move the slider smoothly along a corner of the L-shaped opening by pull the pull tab without changing the initial grip of the pull tab.

Obviously, various modifications and variations of the present invention are possible in the light of the above teaching. It is therefore to be understood that within the scope of the appended claims the invention may be practiced otherwise than as specifically described.

What is claimed is:

1. A slide fastener slider comprising:

(a) a slider body including a pair of spaced upper and lower wings connected at their front end by a guide post, said slider body having a mounting hole extending through the thickness of said upper wing and said lower wing;

(b) a circular disk having a central guide hole and disposed on said upper wing with said guide hole aligned with said mounting hole, wherein said mounting hole further extends through said guide post;

(c) a pull tab pivotally connected to said circular disk; and (d) a retainer pin having an enlarged head and a shank extending centrally from one side of said head, said head having a diameter substantially the same as the outside diameter of said circular disk, said shank extending loosely through said guide hole and firmly fitted in said mounting hole to join said retainer pin with said slider body while allowing said circular disk to rotate freely about said shank.

2. A slide fastener slider according to claim 1, wherein said mounting hole has a downwardly flared end opening to an outer surface of said lower wing, said shank having a flared end complementary in contour to the shape of said flared end of said mounting hole.

3. A slide fastener slider according to claim 1, wherein said circular disk has in its outer peripheral wall a pair of diametrically opposite cutaway recesses, said pull tab having a bifurcated end including a pair of aligned spindles loosely received in said cutaway recesses, respectively.

4. A slide fastener slider according to claim 1, wherein said circular disk has in its outer peripheral wall a pair of diametrically opposite radial blind holes, said pull tab having a bifurcated end including a pair of aligned spindles loosely received in said radial blind holes, respectively.

5. A slide fastener slider according to claim 1, wherein said circular disk has in its outer peripheral wall a pair of diametrically opposite radial blind holes, said pull tab having a bifurcated end having a pair of aligned transverse holes, and a pair of pivot pins extending through said transverse holes and said radial holes.

6. A slide fastener slider comprising:

(a) a slider body including a pair of spaced upper and lower wings connected at their front end by a guide post, said slider body having a mounting hole extending at least through the thickness of said upper wing;

(b) a circular disk having a central guide hole and deposed on said upper wing with said guide hole aligned with said mounting hole;

(c) a pull tab pivotally connected to said circular disk;

(d) a retainer pin having an enlarged head and a shank extending centrally from one side of said head, said head having a diameter substantially the same as the outside diameter of said circular disk, said shank extending loosely through said guide hole and firmly fitted in said mounting hole to join said retainer pin with said slider body while allowing said circular disk to rotate freely about said shank; and (e) wherein said mounting hole has a stepped counterbore opening to an outer surface of said upper wing and including a large-diameter upper portion and a small-diameter lower portion, said circular disk including a small-diameter lower portion slidably received in said large-diameter upper portion of said stepped counterbore, said shank being stepped and including a large-diameter upper portion extending loosely through said guide hole in said circular disk and seated on said small-diameter lower portion of said stepped counterbore.

7. A slide fastener slider according to claim 6, wherein said large-diameter upper portion of said shank has a length slightly larger than the sum of the thickness of said circular disk and the depth of said smaller-diameter lower portion of said stepped counterbore.

* * * * *